United States Patent [19]

Jenkins

[11] Patent Number: 4,832,614

[45] Date of Patent: May 23, 1989

[54] ELECTRICAL CONNECTOR WITH IMPROVED SHUNT

[75] Inventor: John W. Jenkins, Greensboro, N.C.

[73] Assignee: AMP Incorporated, Harrisburg, Pa.

[21] Appl. No.: 136,784

[22] Filed: Dec. 22, 1987

[51] Int. Cl.[4] ..... H01R 13/703

[52] U.S. Cl. ..... 439/188; 439/595; 439/747

[58] Field of Search ..... 439/507–514, 439/746–749, 188, 595; 200/51.1

[56] References Cited

U.S. PATENT DOCUMENTS

| | | | |
|---|---|---|---|
| 3,275,765 | 9/1966 | Ferdon et al. . | |
| 3,501,736 | 3/1970 | Norris . | |
| 3,869,191 | 3/1975 | Tolnar, Jr. et al. | 439/186 |
| 4,070,557 | 1/1978 | Ostapovitch | 439/188 |
| 4,244,486 | 9/1980 | Zimmerman, Jr. et al. | 200/51.1 |
| 4,460,234 | 7/1984 | Bogese . | |
| 4,482,198 | 11/1984 | Crowley . | |
| 4,501,459 | 2/1985 | Chandler et al. . | |
| 4,552,423 | 11/1985 | Swengel, Jr. | 200/51.1 |
| 4,557,542 | 12/1985 | Coller et al. | 439/595 |
| 4,582,376 | 4/1986 | Olsson | 200/51.1 |
| 4,602,833 | 7/1986 | Grabbe et al. . | |
| 4,685,887 | 8/1987 | Hanning | 439/188 |
| 4,726,787 | 2/1988 | Stine | 439/510 |
| 4,786,258 | 11/1988 | Shaffer | 439/188 |

FOREIGN PATENT DOCUMENTS 2081526 2/1982 United Kingdom .

OTHER PUBLICATIONS

"AMP Shunt" AMP Incorporated Data Sheet 80-603 Issued 6-81.

*Primary Examiner*—Neil Abrams
*Attorney, Agent, or Firm*—Robert W. Pitts

[57] ABSTRACT

An electrical connector having a plurality of terminals in an insulative housing includes an improved locking and shunting assembly. This improved locking and shunting assembly can be inserted into the housing of the electrical connector from the mating face to both lock terminals in position and to shunt or common adjacent terminals. Each shunt comprises a resilient terminal which is attached to an insulative locking member by simply sliding the terminal across one surface of the locking member to establish locking engagement between the stamped and formed shunt and the insulative locking member at both ends of the shunt.

19 Claims, 8 Drawing Sheets

26
14
50
62
42
28
88
40
24
12
20
96
90
94
49
92
102
98
20
100

ELECTRICAL CONNECTOR WITH IMPROVED SHUNT

BACKGROUND OF THE INVENTION

1. Field of the Invention

This invention relates to an electrical connector and to means for both locking terminals in place within an insulative housing in the connector and for shunting plural terminals within the connector, and more particularly relates to an easily manufactured locking and shunting assembly.

2. Description of the Prior Art

Electrical connectors having terminals secured within the connector by resilient insulative latch arms which forms part of the connector housing are used in applications where it is essential to have the terminals locked or held in place within the connector housing. Some connectors of this type employ secondary locking members which can be inserted into the mating face of a connector housing to engage the terminal latch arms which comprise an integral part of the housing. U.S. Pat. No. 4,557,542 discloses one example of a connector of this type.

U.S. patent application Ser. No. 049,633 filed May 13, 1987 now U.S. Pat. No. 4,786,258 discloses an electrical connector in which a locking member, insertable from the mating end of a plug connector, includes a plurality of resilient shunt members attached to one surface of the generally planar insulative locking member. That patent application discloses a method of securing the shunt members to the insulative housing by cold staking a central boss to permanently deformingly enlarge the top of the central boss to overlap free ends of lock tabs on a fixed end of the shunt.

The instant invention constitutes an improved locking shunt assembly in which the individual resilient shunts can be assembled to a generally planar insulative locking member by simply sliding each shunt parallel to a shunt lengthwise axis along an upper surface of the generally planar locking member to secure the leading end and the trailing end of each shunt to the locking member. No reciprocal action or staking is necessary.

SUMMARY OF THE INVENTION

An improved shunting member for use in an electrical connector having a plurality of terminals positioned side-by-side in an insulative housing is disclosed. The shunting assembly is adapted to resiliently engage plural terminals and, in the preferred embodiment, individual shunts bridge two adjacent terminals. Shunts are positioned on an insulative member disposed laterally adjacent the terminals to be shunted and, in the preferred embodiment of this invention, the insulative member comprises a removable locking member which can be inserted into the terminal housing from the forward or mating end. In the improved shunt assembly, the individual shunts can be attached to securing members on the insulative housing simply by moving each shunt parallel to a shunt lengthwise axis and sliding the shunt along an upper face of the insulative member.

Each shunt has a resilient bowed mid-section for contacting plural terminals with latches adjacent the leading end and the trailing end of the shunt. Each latch engages a complementary securing member comprising an aperture or a shoulder on the insulative member. The trailing end latch of the shunt has a generally flat base with laterally extending edges which can be inserted beneath channels formed on projections extending upwardly from the planar surface of the housing. A deflectable tab located on the trailing end latch engages a recessed shoulder in the latch at the same time the lateral edges of the latch base are positioned in channels. Thus, the trailing end of the shunt can be fixedly secured or attached to the insulative locking member without requiring any staking operations.

DETAILED DESCRIPTION OF THE PREFERRED EMBODIMENT

Connector assembly 10 includes mating first and second connector members comprising a receptacle header 12 and at least one similar plug 14 matable with the receptacle to establish electrical connections between terminals carried in the plugs and associated terminals carried in the receptacle. Stamped and formed shunts in each plug electrically common selected pairs of adjacent plug terminals when the plug is unmated or partially mated with the receptacle.

Figure 4:
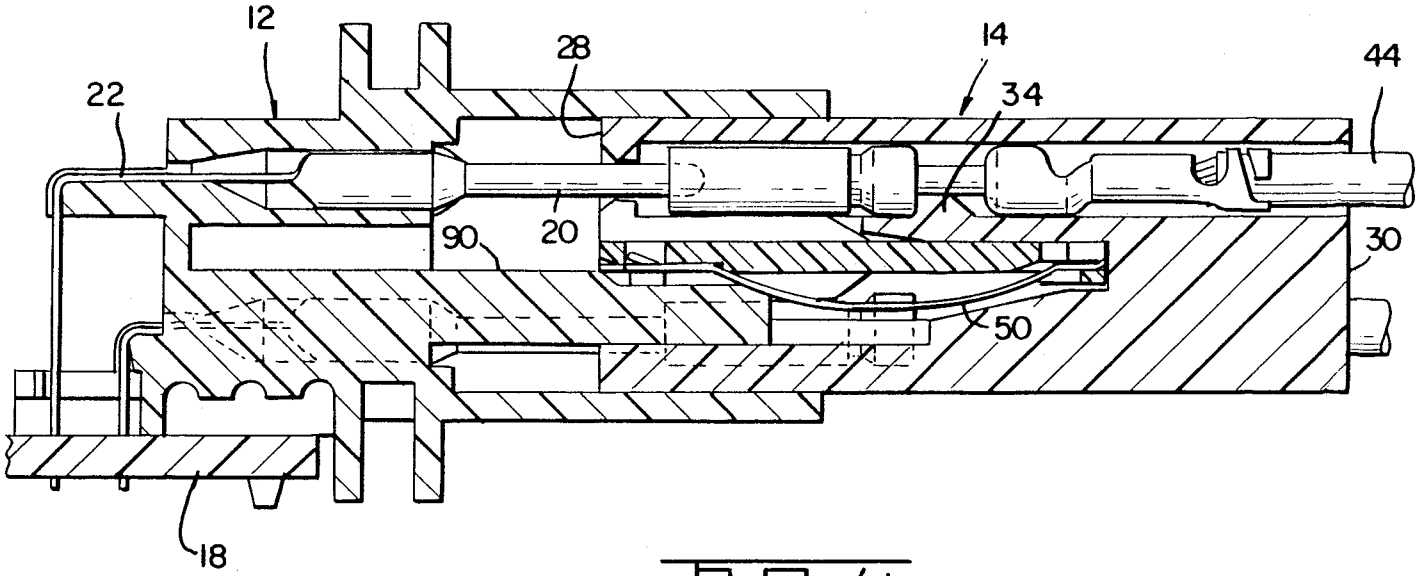
FIG. 4 is a sectional view of a mated plug and receptacle showing engagement of a shunt with one of the terminals in the plug member.

Receptacle header 12 includes a molded insulative housing 16 adapted to be mounted on a circuit board 18 as shown in FIG. 4. Housing 16 carries a plurality of side-by-side pin terminals 20 projecting outwardly of the housing and having right angle terminal tails 22 extending rearwardly through the housing and downwardly to the circuit board 18. Pin terminals 20 are arranged in two spaced groups each including an upper and lower row of side-by-side terminals with the terminals in the upper row staggered between the terminals of the lower row. The housing includes a shroud 24 surrounding each group of terminals 20.

Plug 14 includes a molded plastic housing 26 having a front face 28, a rear face 30 and a plurality of cavities 32 extending between the faces 28 and 30. The cavities 32 are arranged in two rows in the pattern of pin terminals 20 for receiving the terminals of one group upon insertion of the plug into the appropriate shroud 24. A terminal locking arm 34 integral with housing 26 comprises an inner wall portion of each cavity 32. A slot 36 extends across the width of the housing between the rows of cavities 32 and their respective terminal locking arms 34 from front face 28 rearwardly to bottom 38. A generally planar insulative locking member 40 is normally fitted within slot 36 and forms part of the housing 26.

Female terminals 42 are crimped onto the ends of insulated wires 44 and then moved through openings in rear face 30 of housing 26 and into cavities 32. This is done prior to inserting the locking member 40 into slot 36. The terminals 42 flex terminal locking arms 34 into slot 36 out of the terminal insertion path as terminals 42 are moved to the forward ends of respective cavities 32 adjacent front face 28. Following positioning of the terminals 42, terminal locking arms 34 snap back, as shown in FIG. 4, to confine terminals 42 within the plug housing and secure them against axially rearward movement. Wires 44 extend away from the plug for attachment to suitable circuit members. Each plug housing 26 includes means such as an integral exterior housing fastener 46 engageable with a lug (not illustrated) formed on the interior surface of the appropriate shroud 24 for fastening plug 14 to receptacle 12 upon mating.

Figure 8:
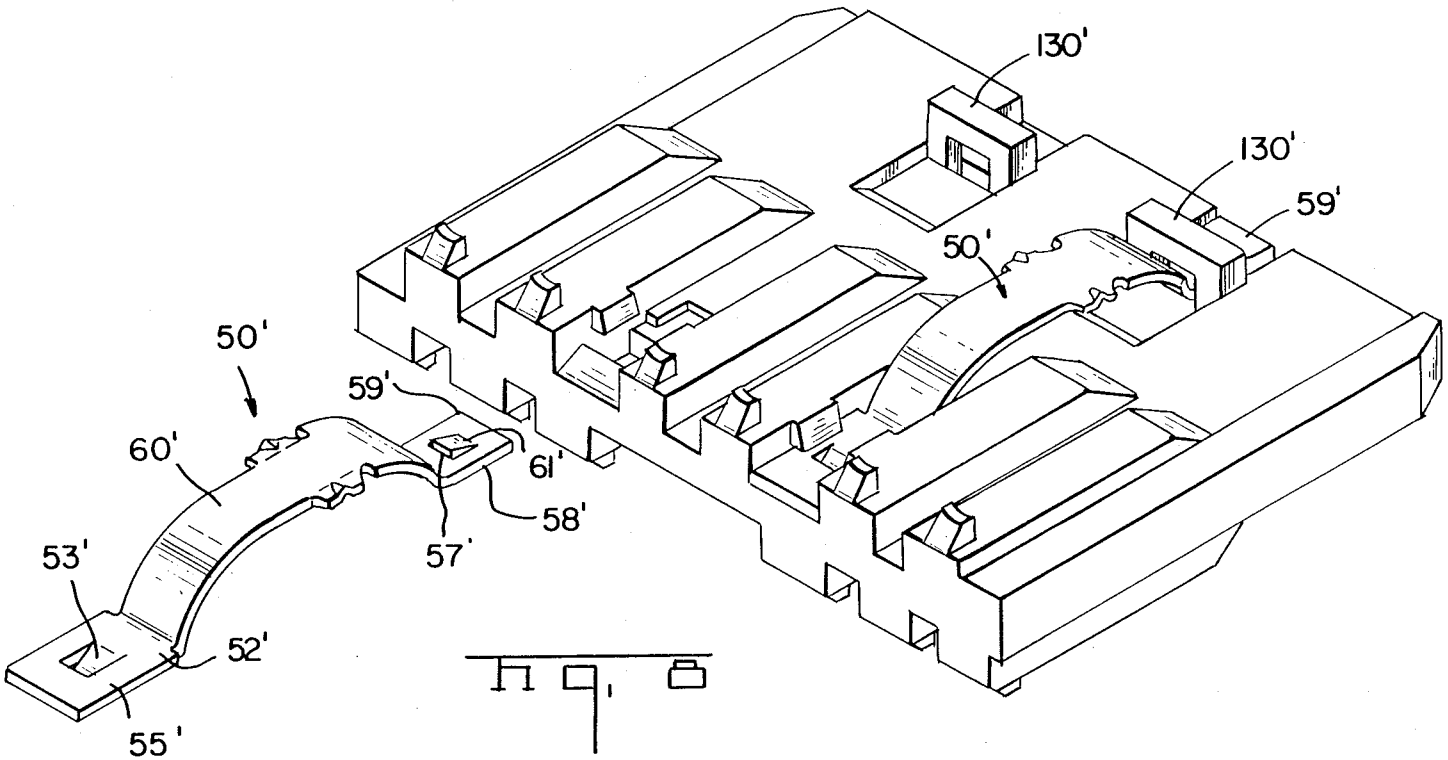
FIG. 8 shows a second embodiment of the locking and shunt assembly.

An embodiment of shunt 50 comprises a stamped and formed member fabricated from a resilient material. Each shunt 50 has a fixed latch 52 and a movable latch 58 adjacent opposite ends of the shunt 50. Latch 58 is adjacent the leading end 56 of the shunt and can also be referred to as the leading end latch 58. Latch 52 is adjacent the trailing end 54 of the shunt 50 and can also be referred to as the trailing end latch 52. A resiliently deflectable bowed mid-section 60 protrudes above the plane of latches 52 and 58 and extends between the leading end 56 and the trailing end 54. A pair of bridging contact wings 62 extend from opposite edges of the shunt 50 and are located at the crest 64 of the bowed mid-section 60. A pair of anti-stubbing wings 66 also extend from the edges of the shunt 50 and are located between the bridging contact wings 62 at the crest of the mid-section 66 and the leading end 56. The leading end or movable latch 58 comprises a finger narrower than the adjacent portion of the shunt which comprises the forwardmost projection of the shunt 50. The trailing end or fixed latch 56 has a generally flat or planar base 55 having opposite edges 55a and 55b which extend laterally beyond the portion of the bowed mid-section 60 adjoining the base 55. In other words, the base 55 is wider than the bowed mid-section 60. A resilient, deflectable tab 53 extends below the surface of the base 55 while the bowed mid-section 60 protrudes upwardly from the plane of the base 55. A second embodiment of the shunt 50' shown in FIG. 8 has a leading end or movable latch 58' which differs from the latch 58. Latch 58' has a central opening 57' stamped in a flat section 59' extending from the forward end of the bowed mid-section 60'. An upwardly formed tab 61' is defined within the opening 57' and extends upwardly in the opposite direction from the downwardly extending tab 53' located in the base 55' in the fixed or trailing end latch 52'. Shunt 50' is otherwise identical to shunt 50.

Figure 7A:
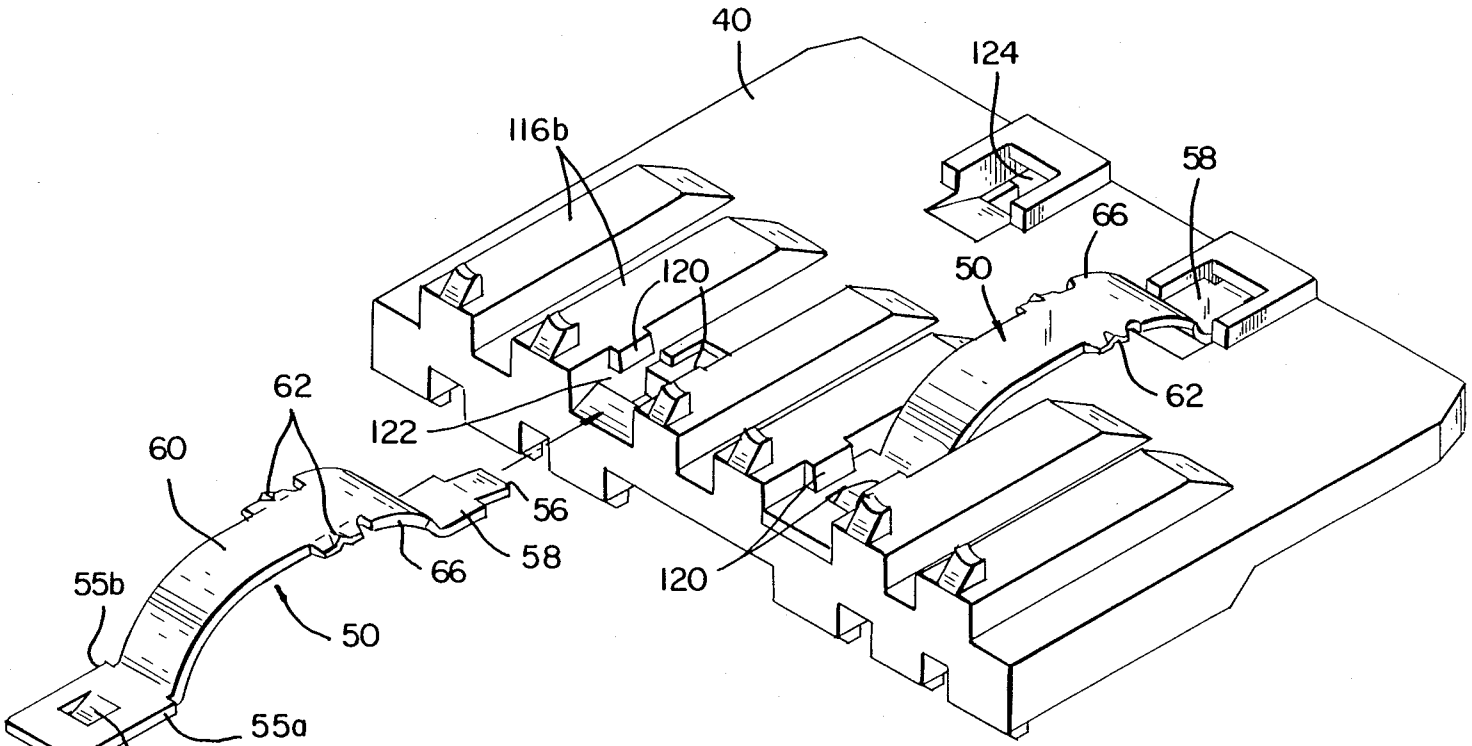
FIGS. 7A, 7B and 7C show the manner in which the terminal shown in FIG. 6 is inserted into engagement with locking member.
Figures 7B, 7C:
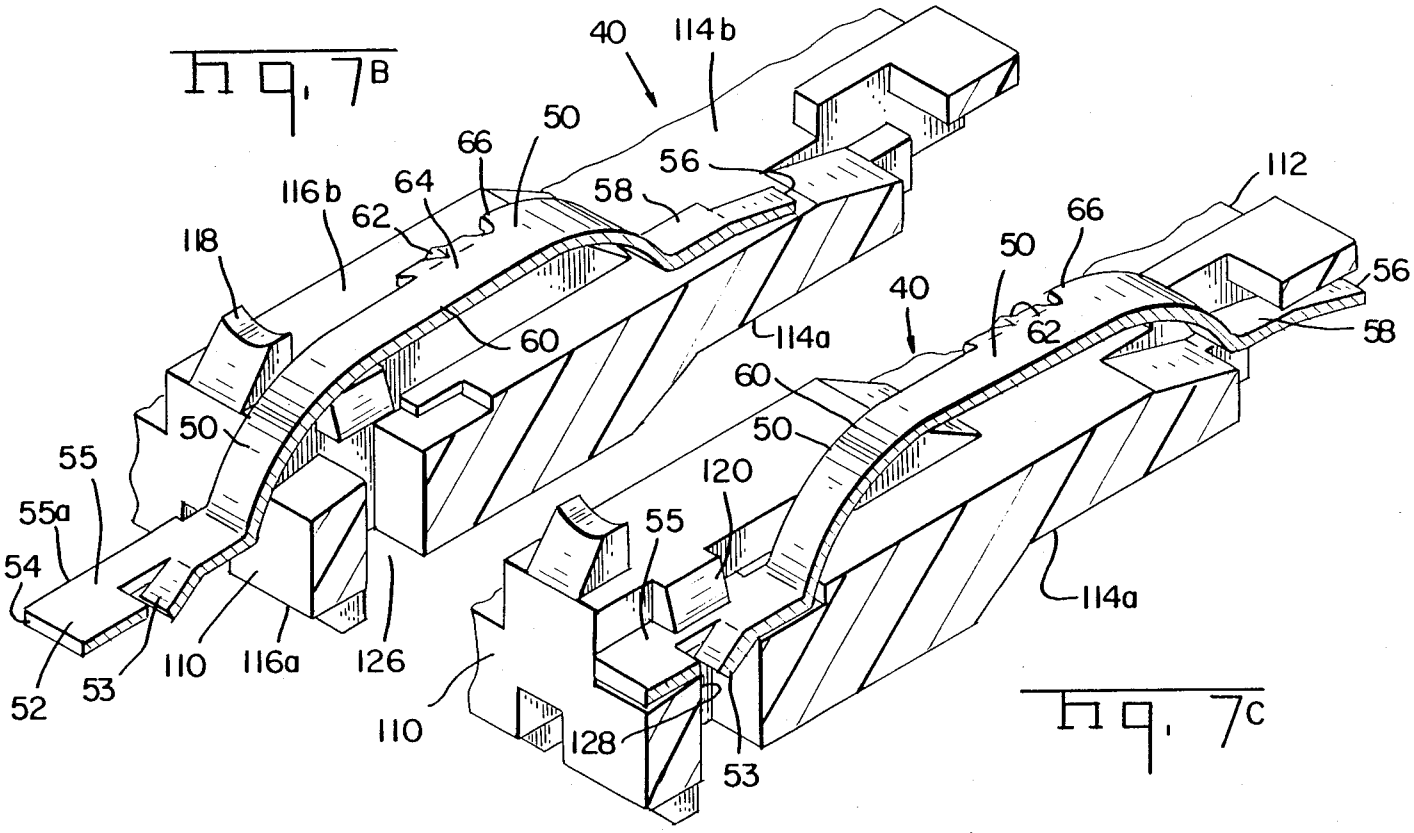

Shunt 50 can be mounted on a generally planar insulative locking member 40 which comprises a secondary locking member for retaining the terminals 42 in the plug housing. Locking member 50 has a trailing edge 110 and a leading edge 112 and opposite ends of two opposite or generally planar surfaces or faces 114*a* and 114*b*. A series of locking ribs or projections 116a and 116b project outwardly from faces 114*a* and 114*b* respectively. FIGS. 7A–7C most clearly shows the manner in which the shunt 50 is attached to the locking member 40 on face 114a which will be defined as the upper face. The projections 116*a* and 116*b* engage terminal locking arms 34 when the locking member 40 is received within the housing slot 36 and serve to retain the terminals 42 in a stable position within the housing. Raised locking surfaces 118 on each rib 116*a* and 116*b* engage the mating end of each terminal 42 to prevent rearward movement of the terminals 42 from the housing. At least two of the projecting ribs 116*b* are spaced apart by a distance at least equal to the width of the bowed mid-section 60 of shunt 50 adjacent the latch 52, thus allowing the shunt leading end 56 to pass between the adjacent ribs 116*b* when the shunt 50 is moved in a direction parallel to the shunt lengthwise axis from the trailing edge 110 toward the leading edge 112 of the locking member 40. Two adjacent projecting ribs 116*b* having opposed ledges 120 define channels 122 at the bottom of the ribs 116*b*. The channels have a height at least equal to the thickness of the metal stock from which shunt 50 is stamped. The trailing end latch 52 of shunt 50 can be positioned between two adjacent ribs 116*b* having ledges 120 with lateral edges 55*a* and 55*b* located in the open ended channels 122 below ledges 120. Locking member 40 also has at least one leading edge aperture 124 and at least one trailing edge aperture 126, each below the position of shunt leading end latch 58 and shunt trailing end latch 52 respectively. A recessed shoulder 128 defines one side of the trailing edge aperture 126 and the resilient tab 53 is oriented to engage the recessed shoulder 128 to prevent withdrawal of the shunt 50 after complete insertion of locking member 40. In the second embodiment, locking member 40' is adapted to engage shunt 50' and, except for the leading edge securing member, is otherwise identical to locking member 40. A U-shpaed strap 130' extends above aperture 124' in the leading edge securing member. Strap 130' is adapted to engage an upwardly angled tab 61'.

On or more shunts 50 are assembled to the planar insulative locking member 40 by simply sliding an individual shunt 50 along a lengthwise shunt axis along the planar face 114*b* from the trailing edge 110 toward the leading edge 112 of locking member 40. No additional assembly steps are required. The leading end 56 of shunt 50 is narrower than adjacent projecting ribs 116*b* having opposed ledges 120 so as to freely pass through this gap. Continued sliding movement of the shunt eventually brings leading end latch 58 having a downwardly projecting finger or tongue into engagement with the leading edge aperture 124. Latch 58 engages the leading end aperture 124 so as to prevent upward movement of the leading end 56 away from the locking ember 40. Note that leading end 56 continues to be axially movable and in the preferred embodiments, the free end retains partial lateral or side to side mobility so that the shunt 50 can partially float to ensure that shunting contact is established between two adjacent terminals 42 even in the event of partial misalignment. The trailing end 54 of shunt 50, having base 55 with relatively wide laterally extending edges 55*a* and 55*b* moves between adjacent projections 116*b* having ledges 120 when the leading end 56 is moved into engagement with leading edge aperture 124. The edges 55*a* and 55*b* are inserted into channels 122 below ledges 120 to prevent upward movement of the trailing end 54 of the shunt 50. The tab 53 in base 55 is upwardly deflected during insertion of the shunt and springs back to its normal position when tab 53 is disposed over trailing edge aperture 126. Tab 53 engages recessed shoulder 128 to prevent rearward movement of the shunt 50. Trailing end 54 is now fixed while the leading end 56 retains some mobility. Latches 52 and 58 are thus properly engaged by complementary latch securing members at the landing and trailing edges of the insulative locking member 40. Since the shunt 50 is resilient, rearward movement of the leading end 56, flexing the bowed mid-section is possible. Rearward movement thus disengages leading end 56. Since the channel 122 are open on both ends and tab 53 is deflectable, the base 55 can be pulled forwardly out of channels 122 to disengage the shunt 50 for removal or replacement. The second embodiment differs in that strap 130' more securely retains the leading end 56', which must now be bent beyond repair to permit removal of the terminals.

Figure 5A:
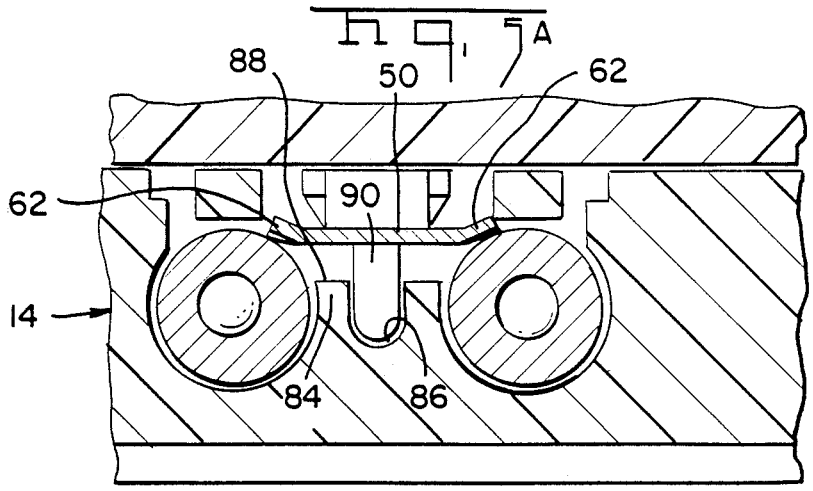
FIGS. 5A and 5B are sectional views showing the engagement and disengagement of a shunt.

As shown in FIG. 5A, the cavities 32 extend only partially around the terminals 42 to provide openings located between terminal locking arms 34 and a longitudinal ridge 84 separating the cavities. Ridge 84 extends rearwardly from front face 28 along terminals 42. A cam support groove 86 having a rounded bottom extends along the top of the ridge 84, with a cam post-receiving opening 88 defined between ridge 84 and locking member 40 between the pair of adjacent terminals 42.

After the shunts 50 have been assembled to locking member 40, the locking member and shunt assembly can be inserted into the slot 36 in position to positively lock the terminals in place and to shunt or bridge selected adjacent terminals 42. The anti-stubbing wings 66 on each shunt 50 engage the terminals 42 during insertion of the locking member 40 to partially deflect the shunt 50, thus preventing any undesirable tendency of the bridging contact wings 62 at the crest of the bowed mid-section 60 from stubbing against the terminals 42. Upon complete insertion, the locking member 40 locks terminal locking arms 34 in position to prevent withdrawal of terminals 42. Bridging contact wings 62 engage adjacent terminals to establish an electrical shunt. Since the leading end 56 of each shunt can float laterally, the shunts 50 will still engage two adjacent terminals 42 even though the terminals 42, the shunts 50 or the locking member 40 might be slightly misaligned.

The receptacle 12 includes four cantilever cam posts 90 each engageable with the bowed mid-section of one of the shunts 50 upon insertion of plugs 14 into the receptacle. Cam posts 90 extend forwardly of receptacle body 16 parallel to pin terminals 20. Each post is located between two pin terminals 20 in the lower row of terminals which form electrical connections with the two female terminals 42 in the plug to either side of a ridge 84. As shown in FIG. 4, the posts 90 are longer than the terminals 20.

Each post 90 includes a forward end 92, a first ramp surface 94 angling up at a shallow angle at the top of the end to a flat dwell surface 96 extending from the end of the first ramp surface 94 a distance toward the body 16. A second ramp surface 98 angles upwardly from the inner end of the dwell surface to a flat top surface 100 which extends rearwardly to housing 16. The upper surfaces of the cam post have a width equal approximately to the width of the shunt 50. A narrow rounded spine 102 extends along the bottom of the cam post from housing 16 to forward end 92. Spine 102 has a sliding fit within groove 86.

Figure 1:
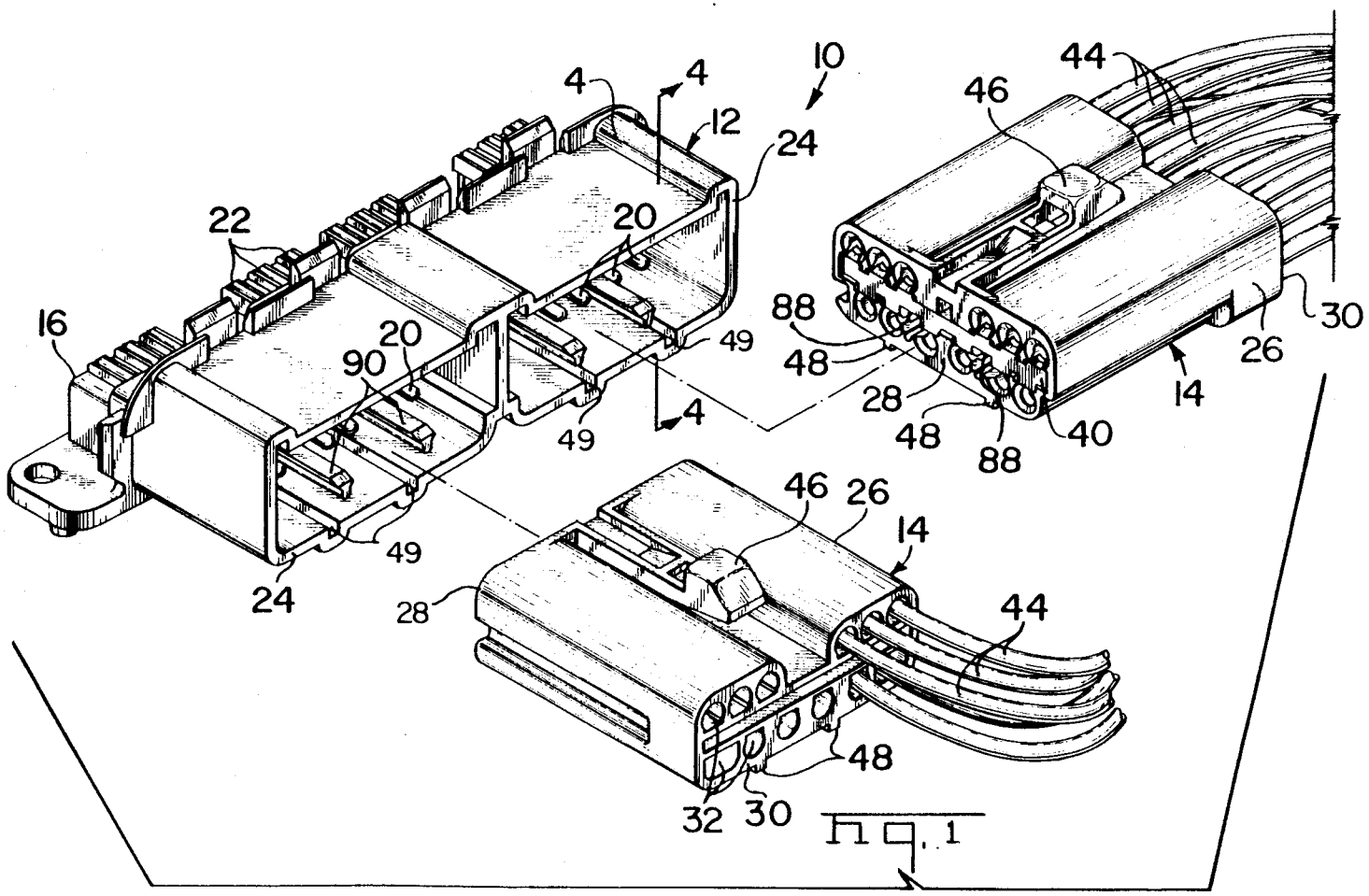
FIG. 1 is a exploded perspective view showing a receptacle header with two mating plug connector members.
Figure 2:
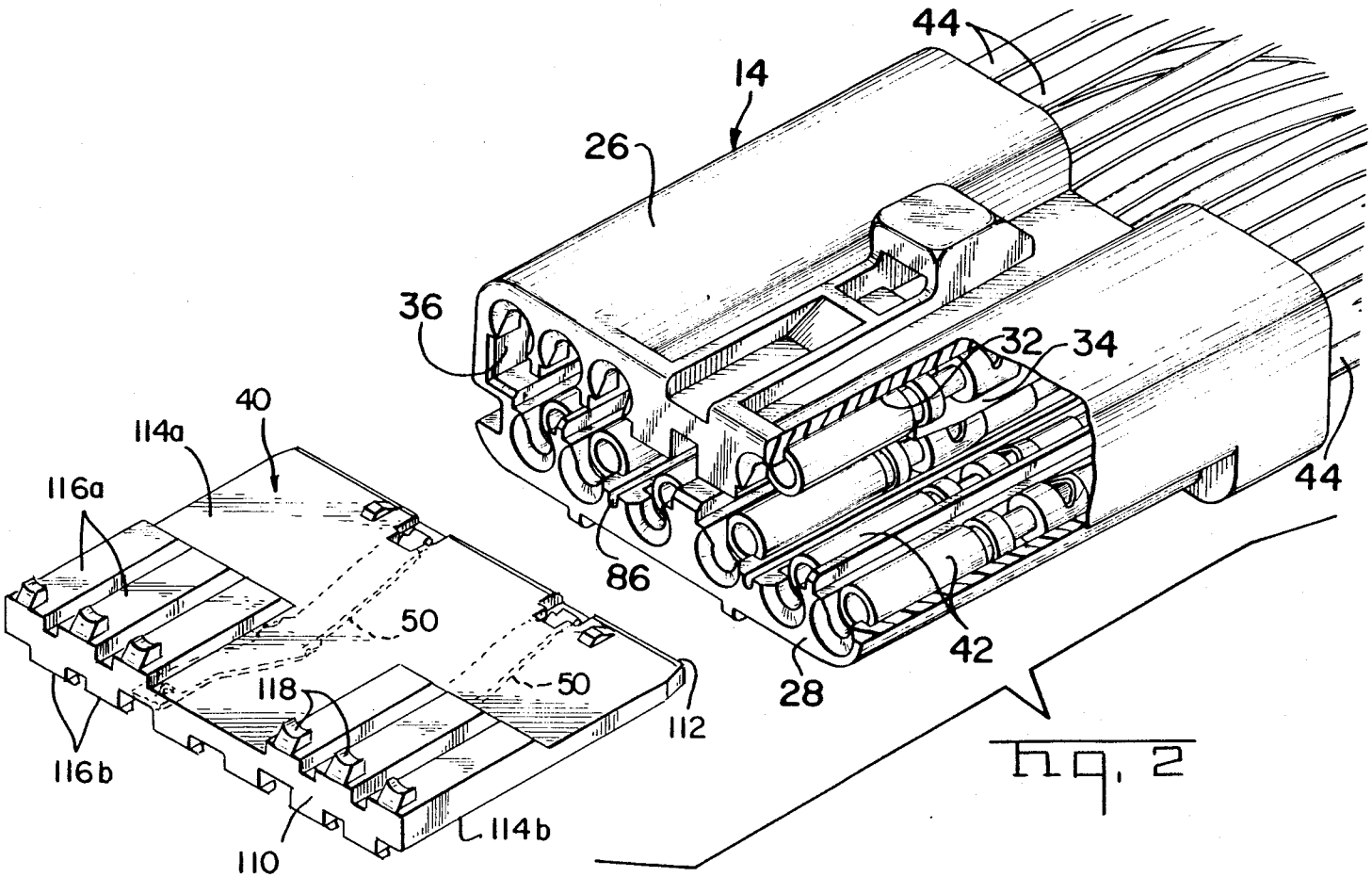
FIG. 2 is a perspective view of a plug member, such as that shown in FIG. 1, showing a locking and shunting member exploded from the mating face of the plug.
Figure 3:
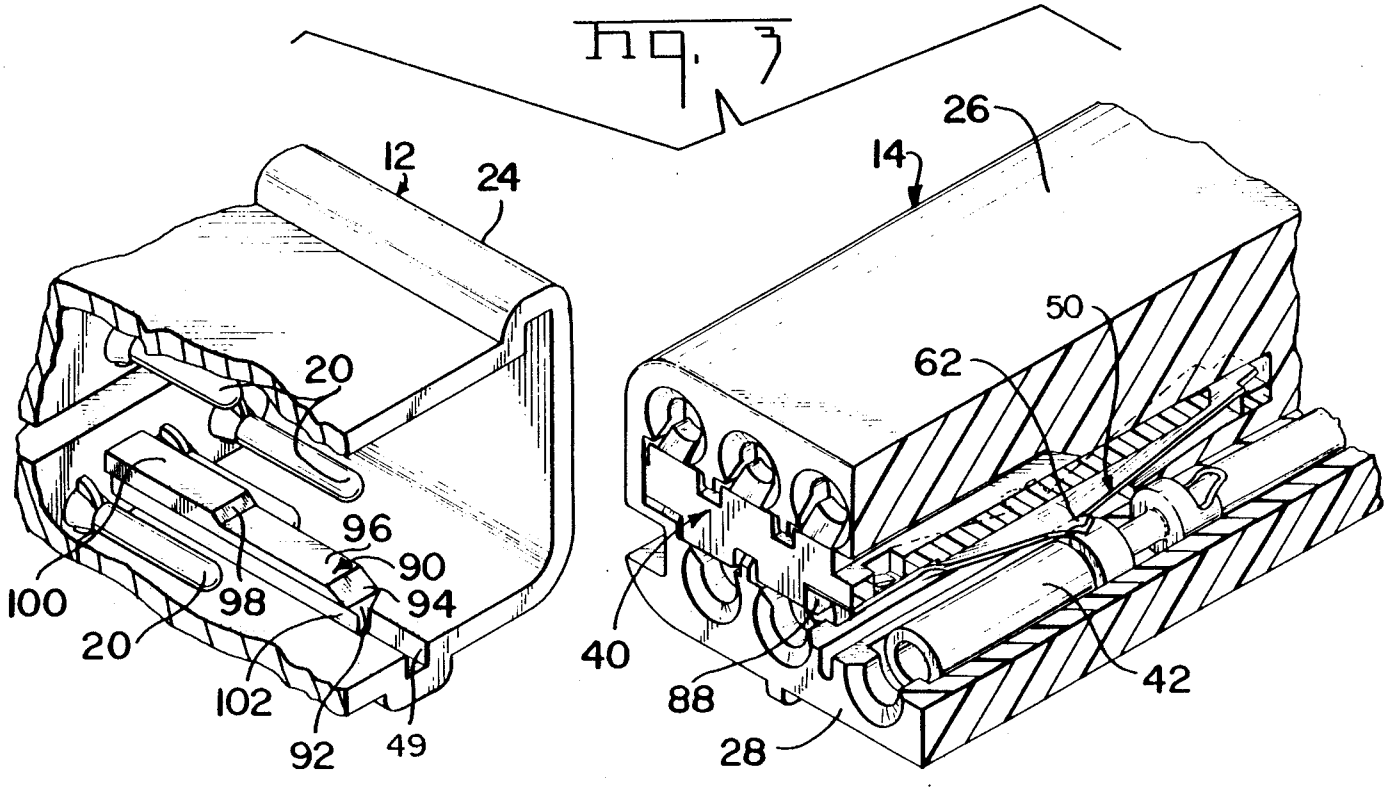
FIG. 3 shows the mating faces of a receptacle and a plug connector in which the locking and shunting assembly has been positioned.

When plugs 14 are withdrawn from receptacle 12, as shown in FIG. 1, the shunts 50 hold wings 62 against the adjacent female terminals 42 thereby forming an electrical connection between the terminals and thus between their associated wires.

Each plug is mated with the receptacle by first positioning the plug in proper alignment in front of the receptacle shroud 24, as shown in FIG. 4, with polarizing ribs 48 aligned with the respective polarizing grooves 49 (see FIG. 1). The plug is then moved into the shroud so that forward ends 92 of cam posts 90 extend freely into cam post-receiving openings 88 above the ridges 84 with the rounded spines 102 fitted in grooves 86. Movement of the plug toward the receptacle brings the lead ends of the female terminals 42 into contact with the tips of pin terminals 20 to form initial electrical connections between the terminals, and moves the second ramp surfaces 98 on cam posts 90 against bowed mid-section 60 of shunt 50 extending between the crest 64 and the fixed end 54.

Figure 5B:
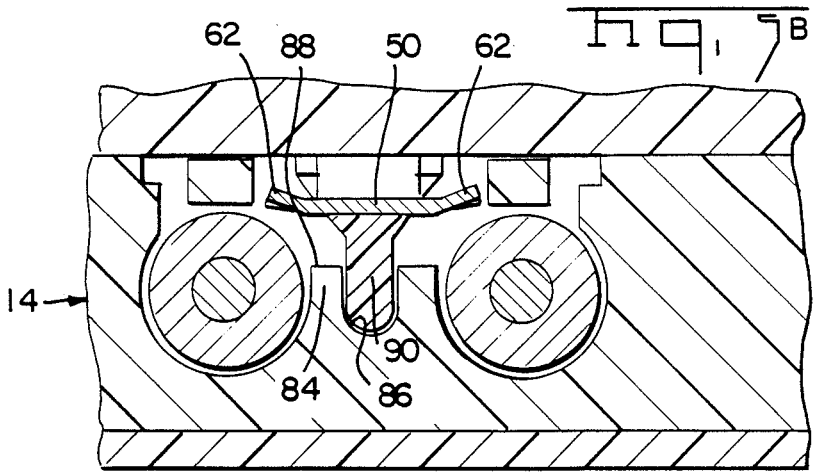
Figure 6:
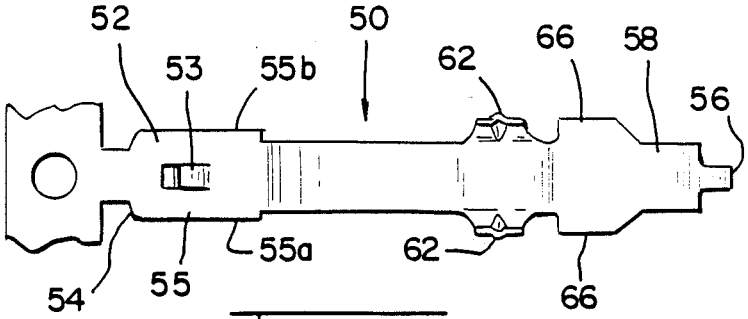
FIG. 6 is a view of a stamped and formed shunt member shown on a carrier strip.

Further movement of the plug into the receptacle fully seats the pin terminals 20 into the socket terminals 42. At the same time, second ramp surface 98 of each cam post 90 lifts and collapses the bowed mid-section of the shunt 50 so that wings 62 are moved up away from the adjacent female terminals 42 to break the electrical connection between the terminals (see FIG. 5B). During this step, the cantilever cam posts 90 are supported against deflection by ridges 84. When the plug is fully inserted, the resilient shunt crests 64 rest on flat dwell surfaces 96 of the supported cam posts 90. Collapse of each of the resilient shunts 50 moves free end 56 longitudinally. Dwell surface 96 is spaced a sufficient distance below locking member 40 to provide room for crest 64 and upwardly angled wing 62 of a resilient shunt 50, as shown in FIGS. 4C and 5B. Top surface 100 has a close sliding fit with the lower surface of locking member 40 and the fixed end 54 of shunt 50 to fill the space between the formerly bridges female terminals 42 with dielectric material.

After the plug has been fully inserted into the receptacle, the shunt has been removed from the connector circuitry and each of the previously bridged female terminals 42 to either side of ridge 84 forms part of an independent circuit path.

In some applications it may be desirable to dedicate one of each pair of female terminals 42 and its associated wire to a circuit for indicating whether the plug 14 is or is not fully mated with the receptacle 12. For instance, the wire connected to one of the pairs of terminals 42, shown in FIGS. 5A and 5B, may be connected to a remote visual indicator (not shown) actuated when the bridge contact forms an electrical connection between the female terminals. Such an application is particularly useful when the connector assembly 10 is part of a safety system and there is a need to indicate when the plug is or begins to become disconnected from the receptacle and, as a result, the safety system would be inoperative.

The connector assembly 10 may also be used in applications where a number of plugs 14 are connected in series to form part of a databus and are selectively connected to components through receptacles 12. In this application the databus remains operable through the bridge contacts when one or more plugs is disengaged from a receptacle.

I claim:

1. In an electrical connector having a plurality of terminals positioned side-by-side in an insulative housing and having at least one shunt resiliently engaging adjacent terminals and resiliently deflectable out of engagement with adjacent terminals, each shunt comprising an elongate member positioned on an insulative member between adjacent terminals, the opposite ends of the elongate member being secured to the insulative member, the improvement comprising: shunt securing means projecting from the plane of each opposite end of each elongate member engageable with complementary securing means on the insulative member between adjacent terminals in response only to movement of the shunt parallel to a shunt lengthwise axis extending between the opposite ends of the shunt.

2. The electrical connector of claim 1 wherein the opposite ends are in substantially the same plane, the mid-section of the shunt being bowed, the insulative member having a generally planar surface with the bowed mid-section of the shunt protruding above the generally planar surface to from a spring member for resiliently engaging adjacent terminals.

3. The electrical connector of claim 2 wherein the shunt securing means comprise a first latch adjacent the leading end of the shunt and a second latch adjacent the trailing end of the shunt, the complementary securing means comprising first and second projecting means extending above the generally planar surface.

4. The electrical connector of claim 3 wherein the second latch comprises a base having at least one edge extending laterally beyond at least the portion of the bowed mid-section adjoining the base, at least one second projecting means having a channel above the generally planar surface, the laterally extending edge of the base being received within the channel upon movement of the shunt parallel to the shunt lengthwise axis.

5. The electrical connector of claim 4 wherein the second projecting means comprises two projections spaced apart by a distance at least equal to the width of the portion of the bowed mid-section of the shunt adjoining the base, each projection having a channel, the base being wider than the portion of the bowed mid-section of the shunt adjoining the base, base edges on opposite sides of the base being received in the channels the two projections.

6. The electrical connector of claim 4 wherein the complementary securing means further comprises a shoulder recessed below the generally planar surface, the second latch further comprising a resilient tab extending below the base, the resilient tab being upwardly deflectable upon movement of the shunt in a first direction parallel to the shunt lengthwise axis, the tab engaging the shoulder to prevent movement of the shunt in a second direction opposite to the first direction to prevent disengagement of the shunt from the insulative member.

7. The electrical connector of claim 6 wherein each of the channels is open ended, the first latch being releasably engageable with the first projecting means, disengagement of the first latch from the first projecting means permitting movement of the edges of the second latch in the first direction out of the channel to disengage the second latch from the second projecting means.

8. The electrical connector of claim 7 wherein the shoulder comprises one surface of an aperture extending through the insulative member.

9. The electrical connector of claim 7 wherein the first latch is releasable engageable with the first projecting means upon movement of the first latch in the second direction, the bowed mid-section of the shunt being resiliently deflectable upon movement of the first latch in the second direction.

10. The electrical connector of claim 3 wherein the first latch is free to slide in a direction parallel to the shunt lengthwise axis when in engagement with the first projecting means, whereby the leading end of the shunt is free to move when the bowed mid-section is deflected.

11. The electrical connector of claim 10 wherein the first projecting means comprises a U-shaped strap, the first latch including an upwardly angled tab engageable with the U-shaped strap.

12. The electrical connector of claim 1 wherein the insulative member comprises a separate generally planar member insertable in a complementary slot in the housing, the shunt being securable to the insulative member prior to insertion in the slot.

13. The electrical connector of claim 12 wherein each shunt has a bowed mid-section extending from a shunt leading end and a shunt trailing end and having an intermediate crest protruding above the insulative member, the bowed mid-section having a pair of bridging contact wings extending from opposite edges of the bowed mid-section at the crest thereof and a pair of anti-stubbing wings, separate from the bridging contact wings, extending from opposite edges of the bowed mid-section between the shunt leading end and the apex, whereby the bridging contact wings engage adjacent terminal after insertion of the insulative member into the slot and the anti-stubbing wings engage the two adjacent terminals during insertion of the insulative member into the slot to prevent the bridging contact wings from stubbing on the contacts.

14. In an electrical connector assembly comprising first and second mating electrical connector members, each connector member having a plurality of terminals positioned within an insulative housing, the first connector member including at least one cam, the second connector member having at least one shunt mounted on one face of an insulative member, each shunt being spring biased into engagement with a pair of adjacent terminals, the cam engaging the shunt to deflect the shunt out of engagement with adjacent terminals when the first and second connectors are mated; the improvement comprising a leading end latch and a trailing end latch on each shunt and a terminal shunting portion between the leading end latch and the trailing end latch on each shunt, each latch being attachable to the insulative member by sliding movement of the shunt along the one face of the insulative member.

15. The electrical connector assembly of claim 14 wherein the insulative member is insertable into a slot in the second connector member, the insulative member including a plurality of ribs engageable with the terminals, each shunt extending between two adjacent ribs.

16. The electrical connector assembly of claim 15 wherein the trailing end latch includes a base having opposite edges received within opposed channels formed on the adjacent ribs.

17. The electrical connector assembly of claim 16 wherein the trailing end latch includes a deflectable tab extending from the base, the deflectable tab engaging a recessed shoulder in the insulative member.

18. The electrical connector assembly of claim 16 wherein each channel is located below a ledge protruding from a side of each rib, ledges on adjacent ribs being spaced apart by a distance less than the width of the base.

19. In an electrical connector assembly comprising first and second mating electrical connector members, each connector member having a plurality of terminals positioned within an insulative housing, the first connector member including at least one cam, the second connector member having at least one shunt mounted on one face of an insulative member, each shunt being spring biased into engagement with a pair of adjacent terminals, the cam engaging the shunt to deflect the shunt out of engagement with adjacent terminals when the first and second connectors are mated; the improvement comprising a leading end latch and a trailing end latch on each shunt, each latch being attachable to the insulative member by sliding movement of the shunt along the one face of the insulative member, the insulative member being insertable into a slot in the second connector member, the insulative member including a plurality of ribs engageable with the terminals, each shunt extending between two adjacent ribs.

* * * * *